US011618266B2

(12) United States Patent
Suetsugu

(10) Patent No.: US 11,618,266 B2
(45) Date of Patent: Apr. 4, 2023

(54) LIQUID DISCHARGE APPARATUS AND HEAD DRIVE CONTROL DEVICE

(71) Applicant: Yuri Suetsugu, Kanagawa (JP)

(72) Inventor: Yuri Suetsugu, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 24 days.

(21) Appl. No.: 17/237,348

(22) Filed: Apr. 22, 2021

(65) Prior Publication Data

US 2021/0331485 A1 Oct. 28, 2021

(30) Foreign Application Priority Data

Apr. 28, 2020 (JP) ..... JP2020-078907

(51) Int. Cl.

| | |
|---|---|
| ***B41J 2/21*** | (2006.01) |
| ***B41J 2/14*** | (2006.01) |
| ***B41J 2/045*** | (2006.01) |
| ***B41J 29/38*** | (2006.01) |

(52) U.S. Cl.

CPC ..... *B41J 2/2132* (2013.01); *B41J 2/0459* (2013.01); *B41J 2/04541* (2013.01); *B41J 2/1433* (2013.01); *B41J 29/38* (2013.01)

(58) Field of Classification Search

CPC .... B41J 2/2132; B41J 2/04541; B41J 2/0459; B41J 2/1433

See application file for complete search history.

(56) References Cited

U.S. PATENT DOCUMENTS

| | | | | |
|---|---|---|---|---|
| 6,375,297 | B1 * | 4/2002 | Hayashi | B41J 25/308 347/14 |
| 2008/0007587 | A1 * | 1/2008 | Watanabe | B41J 29/393 347/19 |
| 2013/0258368 | A1 * | 10/2013 | Shigemoto | H04N 1/6044 358/1.9 |
| 2020/0298585 | A1 | 9/2020 | Suetsugu | |

FOREIGN PATENT DOCUMENTS

| | | |
|---|---|---|
| JP | 2013-226803 | 11/2013 |
| JP | 2013-228370 | 11/2013 |
| JP | 2017-030166 | 2/2017 |

* cited by examiner

*Primary Examiner* — Jason S Uhlenhake

(74) *Attorney, Agent, or Firm* — Duft & Bornsen, PC

(57) ABSTRACT

A liquid discharge apparatus includes a recording head, a height changing mechanism, an image sensor, and control circuitry. The head discharges liquid onto a recording medium from above the medium to form an image on the medium. The height changing mechanism changes a height position of the head. The image sensor captures the image on the medium. The control circuitry is configured to: cause the height changing mechanism to change the height position of the head; cause the head to discharge the liquid at different height positions to form adjustment patterns on the medium; cause the image sensor to image the adjustment patterns; select at least one adjustment pattern from the adjustment patterns based on information on an abnormal image obtained from imaging data of the adjustment patterns; and determine, as the height position of the head, a height position corresponding to the at least one adjustment pattern selected.

20 Claims, 7 Drawing Sheets

LIQUID DISCHARGE APPARATUS AND HEAD DRIVE CONTROL DEVICE

CROSS-REFERENCE TO RELATED APPLICATION

This patent application is based on and claims priority pursuant to 35 U.S.C. § 119(a) to Japanese Patent Application No. 2020-078907, filed on Apr. 28, 2020, in the Japan Patent Office, the entire disclosure of which is hereby incorporated by reference herein.

BACKGROUND

Technical Field

Embodiments of the present disclosure relate to a liquid discharge apparatus and a method for adjusting the height of a recording head.

Related Art

There are known inkjet printers that discharge ink from nozzles of a recording head to form an image on a recording medium. In the inkjet printers, the quality of the formed image greatly changes depending on the distance between the recording medium and the recording head.

For example, in an inkjet printer, a correction value for adjusting the gap between a head and a sheet of paper is selected based on a printed test pattern, and the gap between the head and the sheet of paper is adjusted according to the selected correction value.

SUMMARY

According to an aspect of the present disclosure, there is provided a liquid discharge apparatus that includes a recording head, a height changing mechanism, an image sensor, and control circuitry. The recording head is configured to discharge liquid onto a recording medium from above the recording medium to form an image on the recording medium. The height changing mechanism is configured to change a height position of the recording head. The image sensor is configured to capture the image on the recording medium. The control circuitry is configured to: cause the height changing mechanism to change the height position of the recording head; cause the recording head to discharge the liquid at different height positions to form a plurality of adjustment patterns on the recording medium; cause the image sensor to image the plurality of adjustment patterns; select at least one adjustment pattern from the plurality of adjustment patterns based on information on an abnormal image obtained from imaging data of the plurality of adjustment patterns; and determine, as the height position of the recording head, a height position corresponding to the at least one adjustment pattern selected.

According to another aspect of the present disclosure, there is provided a method of adjusting a height of a recording head. The method includes discharging, imaging, and determining. The discharging discharges liquid from the recording head at different height positions from above a recording medium to form a plurality of adjustment patterns on the recording medium while changing a height position of the recording head that is a predetermined position of the recording head above the recording medium. The imaging images the plurality of adjustment patterns with an image sensor; selecting at least one adjustment pattern from the plurality of adjustment patterns based on information on an abnormal image obtained from imaging data of the plurality of adjustment patterns. The determining determines, as the height position of the recording head, a height position corresponding to the at least one adjustment pattern selected by the selecting.

BRIEF DESCRIPTION OF THE DRAWINGS

A more complete appreciation of the disclosure and many of the attendant advantages and features thereof can be readily obtained and understood from the following detailed description with reference to the accompanying drawings, wherein.

Figure 1:
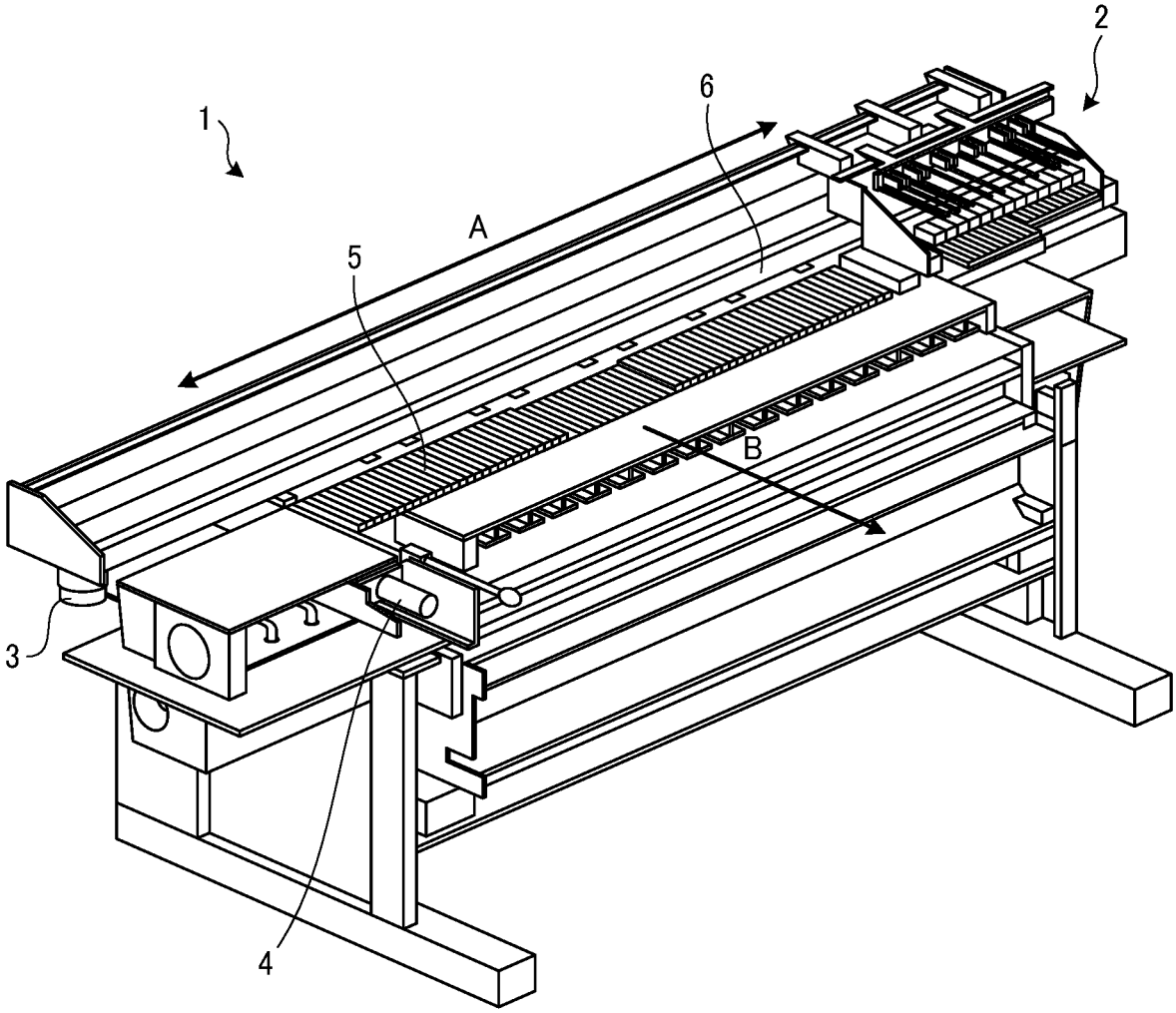
FIG. 1 is a diagram illustrating an example of a configuration of a liquid discharge apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

The terminology used herein is for the purpose of describing particular embodiments only and is not intended to be limiting of the present disclosure. As used herein, the singular forms "a", "an" and "the" are intended to include the plural forms as well, unless the context clearly indicates otherwise.

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

With reference to drawings, descriptions are given below of embodiments of the present disclosure. It is to be noted that elements (for example, mechanical parts and components) having the same functions and shapes are denoted by the same reference numerals throughout the specification and redundant descriptions are omitted.

Hereinafter, embodiments of the present disclosure are described with reference to drawings.

Configuration Example of Liquid Discharge Device

FIG. 1 is a diagram illustrating an example of the configuration of a liquid discharge apparatus according to an embodiment of the present disclosure. As illustrated in FIG. 1, a liquid discharge apparatus 1 according to the present embodiment includes a carriage 2, a main scanning motor 3, a sub-scanning motor 4, a platen 5, and a guide rod 6.

The carriage 2 includes a plurality of inkjet recording heads. The individual recording heads discharge ink of predetermined colors, such as yellow, magenta, cyan, and black. The recording heads are mounted on the carriage 2 so that a discharge surface of each recording head faces downward.

The carriage 2 is supported by a guide rod 6 extending along a main scanning direction A. The main scanning motor 3 is driven to reciprocate the carriage 2 along the main scanning direction A.

A platen 5 is provided at a position facing the discharge surface of the carriage 2 from which ink is discharged. The platen 5 is configured by connecting a plurality of plate-shaped members in the main scanning direction A, for example, and supports a recording medium when ink is discharged from the carriage 2 onto the recording medium.

Recording media are printable objects that vary in size, material, thickness, and the like. The sub-scanning motor 4 is driven to intermittently convey recording media in a sub-scanning direction B.

In other words, once the sub-scanning motor 4 is driven and the recording medium conveyed to the predetermined position is temporarily stopped, the main scanning motor 3 is driven during that time and the carriage 2 reciprocates in the main scanning direction A along the guide rod 6 while discharging ink from the recording heads to the recording medium. Thus, images such as characters, figures, pictures, and photographs are formed on the recording medium.

As described above, the liquid discharge apparatus 1 is configured as, for example, an inkjet printer including at least one inkjet recording head. The liquid discharge apparatus 1 is also a serial printer that moves the carriage 2 to perform printing, for example. The liquid discharge apparatus 1 may be configured as a wide machine in which the carriage 2 has a long movement distance in the main scanning direction A.

Configuration Example of Carriage

Next, a detailed configuration of the carriage 2 included in the liquid discharge apparatus 1 according to an embodiment of the present disclosure is described with reference to FIGS. 2A to 4.

Figure 2A:
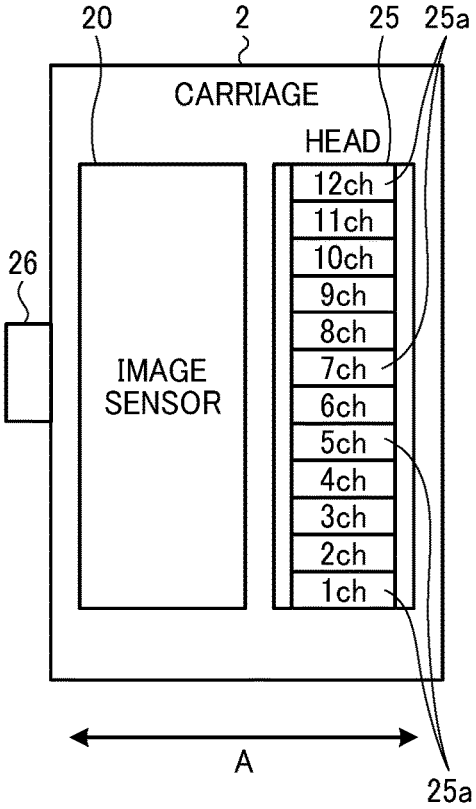
FIGS. 2A and 2B are diagrams illustrating an example of the configuration of a carriage included in the liquid discharge apparatus according to an embodiment of the present disclosure.
Figure 2B:
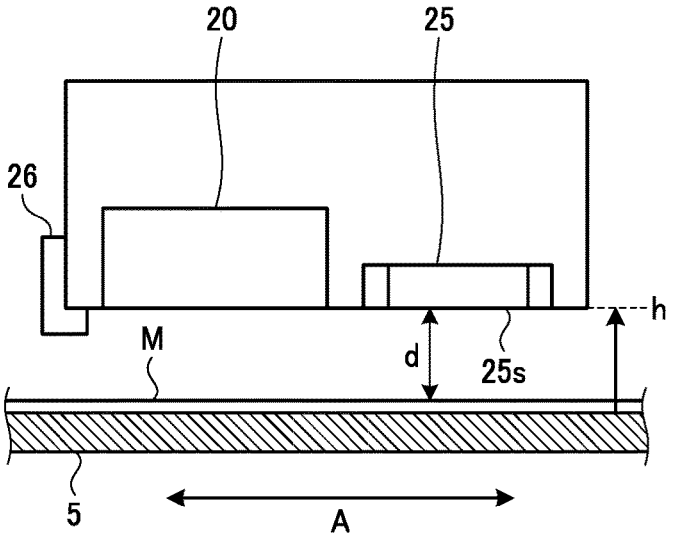

FIGS. 2A and 2B are diagrams illustrating an example of the configuration of the carriage 2 included in the liquid discharge apparatus 1 according to an embodiment of the present disclosure. FIG. 2A is a perspective view of the carriage 2 when viewed from above. FIG. 2B is a cross-sectional view of the carriage 2 when viewed from a lateral side.

As illustrated in FIG. 2, the carriage 2 includes an image sensor 20, a recording head 25, and a height changing mechanism 26. For example, the image sensor 20 and the recording head 25 are arranged side by side in the main scanning direction A and disposed on the lower surface of the carriage 2 The height changing mechanism 26 extends downward from a side surface of the carriage 2, for example.

However, such an arrangement of the image sensor 20, the recording head 25, and the height changing mechanism 26 is merely an example, and the arrangement of the configurations can be arbitrarily changed. Further, the image sensor 20 does not have to be mounted on the carriage 2 and integrated with the recording head 25, and the mounting position of the image sensor 20 may be any position.

The image sensor 20 is, for example, a two-dimensional image sensor in which a plurality of sensors are arranged in a plane. The image sensor 20 captures an image or the like formed on a recording medium M to generate imaging data.

The recording head 25 includes a plurality of nozzles 25*a* from ch1 to ch12 arranged in a direction orthogonal to the main scanning direction A. However, the number and arrangement direction of the nozzles 25*a* may be any other number and arrangement direction. The lower end of each nozzle 25*a* faces the recording medium M placed on the platen 5, and corresponds to a discharge surface 25*s* for discharging ink of the recording head 25.

The height changing mechanism 26 is a mechanism that changes the height position of the recording head 25 by, for example, raising and lowering the entire carriage 2. The lower end of the height changing mechanism 26 extends further below the discharge surface 25*s* of the recording head 25, which is the lower surface of the carriage 2, for example. Such a configuration can restrain the carriage 2 and the like from contacting the recording medium M.

The height position of the recording head 25 is a predetermined position above the recording medium M placed on the platen 5, and is defined by, for example, determining a reference position in the vertical direction in the liquid discharge apparatus 1. That is, for example, the position of the discharge surface 25*s* of the recording head 25 in the height direction from the reference position can be set as the height position of the recording head 25.

In the present specification, the distance between the discharge surface 25*s* of the recording head 25 and the upper surface of the recording medium M is referred to as a gap d. The reference position that defines the height position of the recording head 25 is defined as the upper surface of the platen 5, and the distance of the discharge surface 25*s* of the recording head 25 from the upper surface of the platen 5 is referred to as the height position h of the recording head 25. In other words, the height position h of the recording head 25 is a value obtained by adding the thickness of the recording medium M to the gap d between the discharge surface 25*s* of the recording head 25 and the upper surface of the recording medium M.

Figure 3:
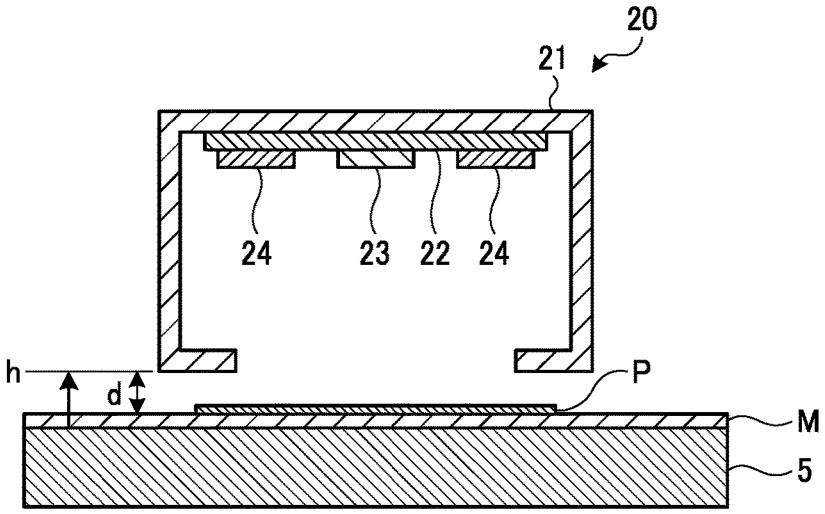
FIG. 3 is a cross-sectional view illustrating an example of the configuration of an image sensor included in the liquid discharge apparatus according to an embodiment of the present disclosure.

FIG. 3 is a cross-sectional view illustrating an example of the configuration of the image sensor 20 included in the liquid discharge apparatus 1 according to an embodiment of the present disclosure. As illustrated in FIG. 3, the image sensor 20 includes a frame 21, a sensor control board 22, a sensor unit 23, and an illumination light source 24.

The frame 21 has a box-shaped shape in which a part of the lower end surface is open, and houses the sensor control board 22, the sensor unit 23, and the illumination light source 24 inside the frame 21.

The sensor control board 22 is fixed to a ceiling portion of the frame 21. The sensor unit 23 and the illumination light source 24 are attached to a lower surface of the sensor control board 22, in other words, a surface facing the recording medium M side.

The sensor unit 23 has a configuration in which a plurality of solid-state imaging elements such as a charge coupled device (CCD) or a complementary metal-oxide sensor (CMOS) are arranged in a plane. The sensor unit 23 captures an image P or the like formed on the recording medium M. The generated imaging data is transferred to a higher-level central processing unit (CPU), which is described later.

The illumination light source 24 is, for example, a light emitting diode (LED) or the like. When the sensor unit 23 captures an image P or the like formed on the recording medium M, the illumination light source 24 irradiates, with light, a region of the recording medium M on which the image P or the like is formed. In order to maintain the illumination conditions at the time of imaging the image P as the same as possible, preferably, the imaging region including the image P is not exposed to external light, and the illumination in the imaging region is illuminated only by the illumination light source 24.

The image sensor 20 including the frame 21 is assembled to the carriage 2 and integrated with the recording head 25 as described above. Accordingly, the image sensor 20 can move above the recording medium M in synchronization with the recording head 25 as the carriage 2 moves above the recording medium M. Further, the height position of the image sensor 20 can be changed in the vertical direction in synchronization with the recording head 25 as the carriage 2 is moved up and down by the height changing mechanism 26 described above.

The distance between the lower end surface of the frame 21 and the upper surface of the recording medium M is substantially equal to the gap d between the discharge surface 25*s* of the recording head 25 and the upper surface of the recording medium M. The distance between the lower end surface of the frame 21 and the upper surface of the platen 5 is substantially equal to the height position h of the recording head 25, which is the above-described distance between the discharge surface 25*s* of the recording head 25 and the upper surface of the platen 5.

Figure 4:
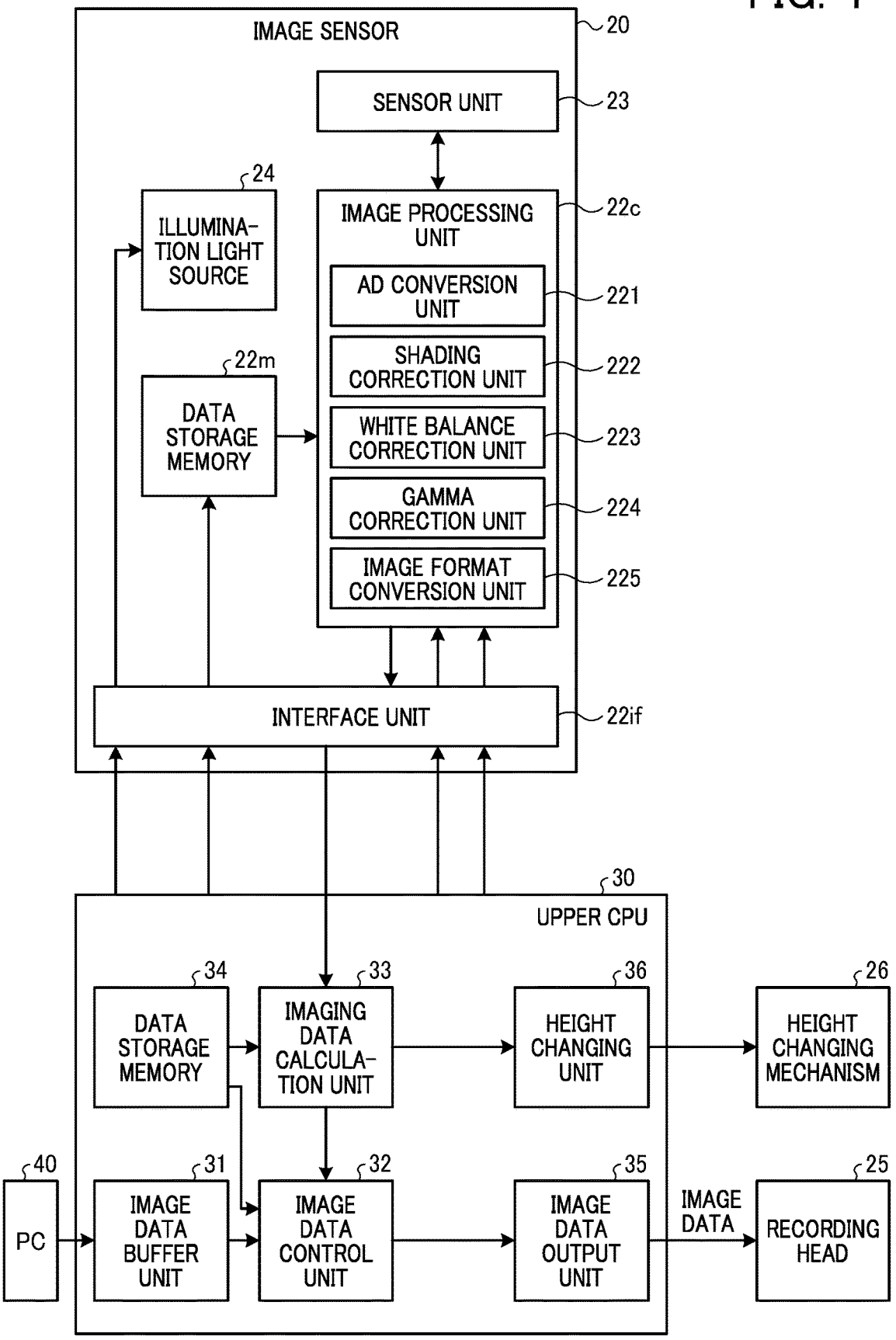
FIG. 4 is a block diagram illustrating an image sensor and an upper CPU of the liquid discharge apparatus according to an embodiment of the present disclosure.

FIG. 4 is a block diagram illustrating the image sensor 20 and the upper CPU 30 of the liquid discharge apparatus 1 according to an embodiment of the present disclosure.

As illustrated in FIG. 4, the image sensor 20 includes the sensor unit 23, the illumination light source 24, and an image processing unit 22*c*, a data storage memory 22*m*, and an interface unit 22*if* implemented by the configuration mounted on the sensor control board 22.

The image processing unit 22*c* includes an analog-to-digital (AD) conversion unit 221, a shading correction unit 222, a white balance correction unit 223, a gamma correction unit 224, and an image format conversion unit 225.

The AD conversion unit 221 performs analog-to-digital (AD) conversion of an analog signal output from the sensor unit 23. The shading correction unit 222 corrects variations in sensitivity among imaging pixels of the sensor unit 23, illumination unevenness, and the like. The white balance correction unit 223 corrects fluctuations in the amount of illumination. The gamma correction unit 224 compensates for the linearity of sensitivity. The image format conversion unit 225 converts digital image data into any image format.

The data storage memory 22*m* stores the imaging data captured by the sensor unit 23 and generated by the image processing unit 22*c*, and is transmitted to the upper CPU 30 via the interface unit 22*if*.

The upper CPU 30 as a control unit or control circuitry is a computer including a read only memory (ROM), a random access memory (RAM), and the like in addition to a CPU. The upper CPU 30 manages the entire liquid discharge apparatus 1 and also controls each part of the liquid discharge apparatus 1.

Examples of the functional units implemented by the CPU reading a control program stored in the ROM into the RAM and executing the control program include an image data buffer unit 31, an image data control unit 32, an imaging data calculation unit 33, a data storage memory 34, an image data output unit 35, and a height changing unit 36.

The image data buffer unit 31 stores image data rendered and transmitted from the PC 40 used by the user of the liquid discharge apparatus 1. When a print command is issued from the PC 40, the image data buffer unit 31 transmits the stored image data to the image data control unit 32.

The image data control unit 32 generates image data to be transmitted to the recording head 25 based on the image data transmitted from the image data buffer unit 31, and transmits the image data to the image data output unit 35. The image data control unit 32 reads data related to an adjustment pattern for adjusting the height position of the recording head 25, which is described later, from the data storage memory 34 and transmits the data to the image data output unit 35.

The image data output unit 35 transmits the image data or the data related to the adjustment pattern to the recording head 25 and discharges ink from the recording head 25. Thus, an image according to the image data from the user or an adjustment pattern according to the data regarding the adjustment pattern is formed on the recording medium M.

The imaging data calculation unit 33 receives the imaging data of the adjustment pattern described later from the image sensor 20, analyzes the imaging contents, and determines an appropriate value of the height position of the recording head 25.

When the height changing unit 36 forms the adjustment pattern on the recording medium M, the height changing unit 36 controls the height changing mechanism 26 described above to change the height position of the recording head 25. The height changing unit 36 controls the height changing mechanism 26 to raise and lower the recording head 25 to the height position determined by the imaging data calculation unit 33.

The data storage memory 34 stores data related to the adjustment pattern, imaging data received from the image sensor 20, analysis results of imaging data by the imaging data calculation unit 33, and the like.

Example of Operation of Height Adjustment

In the liquid discharge apparatus 1 according to an embodiment of the present disclosure such as an inkjet printer, the gap d between the recording medium M and the recording head 25 greatly affects the quality of the formed image. Therefore, when the thickness of the recording medium M or the like is known, the height changing mechanism 26 described above changes the height position of the recording head 25 and adjusts the gap d between the recording medium M and the recording head 25 to be appropriate.

By contrast, when the thickness of the recording medium M or the like is unknown, for example, if an image is formed while the gap d between the recording medium M and the recording head 25 is not appropriate, the ink landing position may shift or a phenomenon called satellite in droplets of ink may occur. In the liquid discharge apparatus 1 according to an embodiment of the present disclosure, such a phenomenon is used to determine the height position of the recording head 25 such that the gap d between the recording medium M and the recording head 25 is appropriate.

Hereinafter, an example of a height adjusting operation in the liquid discharge apparatus 1 when the thickness of the recording medium M is unknown is described with reference to FIGS. 5 to 8.

Figure 5:
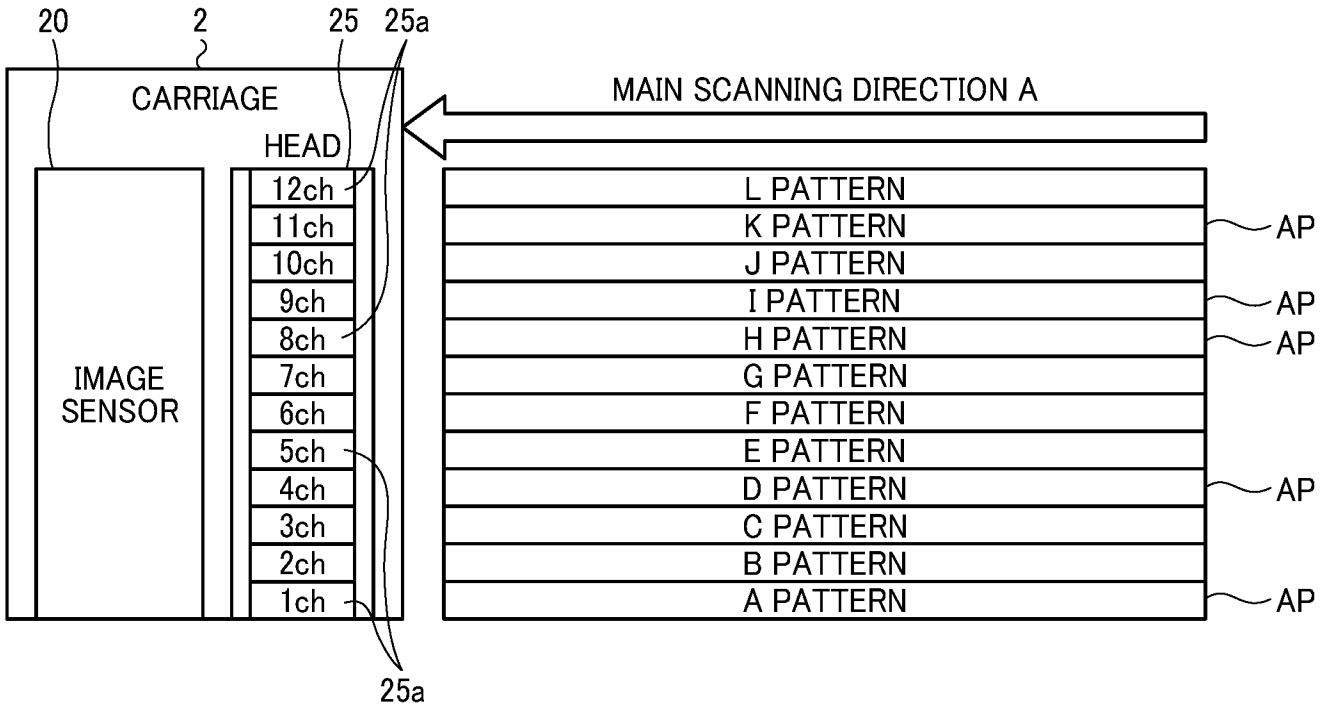
FIG. 5 is a diagram illustrating an operation of forming an adjustment pattern by the liquid discharge apparatus according to an embodiment of the present disclosure.

FIG. 5 is a diagram illustrating an operation of forming an adjustment pattern AP with the liquid discharge apparatus 1 according to the present embodiment. As illustrated in FIG. 5, when the liquid discharge apparatus 1 forms an image on a recording medium M having an unknown thickness, the upper CPU 30 controls each part of the liquid discharge apparatus 1 to form an adjustment pattern AP used for adjusting the height position of the recording head 25.

The adjustment pattern AP is formed by using, for example, two or more nozzles 25*a* among the plurality of nozzles 25*a* from ch1 to ch12 included in the recording head 25. When the liquid discharge apparatus 1 forms the adjustment pattern AP, the upper CPU 30 controls the recording head 25 to discharge ink droplets from a predetermined nozzle 25*a* and cause the ink droplets to land on the recording medium M, while controlling the carriage 2 to move in the main scanning direction A. In the example of FIG. 5, a plurality of adjustment patterns APs from A to L patterns corresponding to the nozzles 25*a* from ch1 to ch12 are formed.

When the liquid discharge apparatus 1 forms the adjustment pattern AP, the upper CPU 30 changes the height position of the recording head 25 at a predetermined timing so that the adjustment pattern AP is formed with ink droplets discharged from the recording head 25 at different height positions. More specifically, the adjustment pattern AP includes a plurality of dots generated by the landing of ink droplets. The height position of the recording head 25 is changed each time a predetermined number of dots in the plurality of dots are formed. Accordingly, the adjustment pattern AP is formed so as to include the plurality of dots formed with ink droplets discharged at different height positions for each predetermined number.

In the adjustment pattern AP, the plurality of dots are formed on the recording medium M at intervals between the dots so that the shapes of the individual dots can be confirmed.

Figure 6:
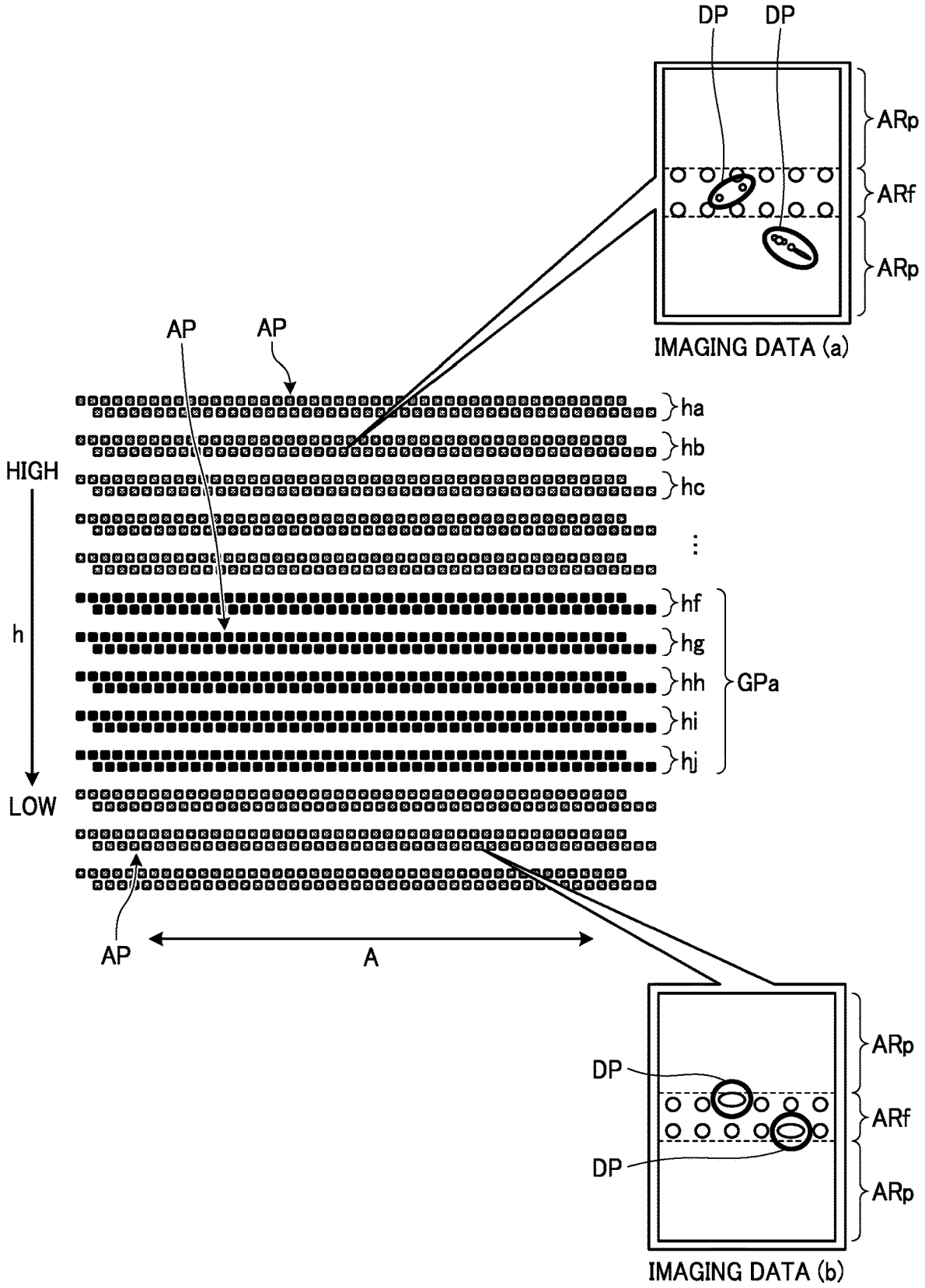
FIG. 6 is a diagram illustrating an example of a plurality of adjustment patterns formed on a recording medium by the liquid discharge apparatus according to an embodiment of the present disclosure.

FIG. 6 is a diagram illustrating an example of a plurality of adjustment patterns APs formed on the recording medium M by the liquid discharge apparatus 1 according to an embodiment of the present disclosure. It is assumed that the plurality of adjustment patterns APs illustrated in FIG. 6 are formed by using two arbitrarily selected nozzles 25*a*.

As illustrated in FIG. 6, the upper CPU 30 forms a plurality of adjustment patterns APs with the two nozzles 25*a* by changing the height position of the recording head 25 each time an array of dots corresponding to the respective nozzles 25*a* is formed, for example, one row at a time and for a total of two rows.

More specifically, the upper CPU 30 first raises the recording head 25 to a limit value of the height changing mechanism 26, in other words, moves the recording head 25 to a position as far as possible from the recording medium M, and starts formation of the adjustment pattern AP from the height position ha of the recording head 25 at that time.

Next, the upper CPU 30 lowers the recording head 25 from the height position ha to the height positions hb, hc, and so on, and causes the recording head 25 to form the adjustment pattern AP at each height position. At this time, the amount of change in the height position of the recording head 25 each time is set to be the minimum value that can be controlled by, for example, the height changing mechanism 26.

When the recording head 25 has been lowered to the limit value of the height changing mechanism 26, in other words, when the recording head 25 has been moved to a position as close as possible to the recording medium M, the upper CPU 30 finishes the formation of the adjustment pattern AP. As described above, for example, the lower end of the height changing mechanism 26 is arranged at a position lower than the discharge surface 25*s* of the recording head 25. Thus, such a configuration can restrain the recording head 25 and so on from contacting the recording medium M even if the recording head 25 is brought close to the recording medium M to the limit value.

The upper CPU 30 captures the plurality of adjustment patterns APs thus formed by the image sensor 20 for each height position of the recording head 25, and analyzes the imaging data including the adjustment pattern AP for each height position of the recording head 25. From such imaging data, information on an abnormal image DP can be obtained. Examples of the information on the abnormal image DP obtained from the imaging data include the presence and absence of the abnormal image DP, the type of the abnormal image DP that has occurred, the location of the occurrence, the frequency of occurrence, and the like.

The abnormal image DP may be included in and around the adjustment pattern AP formed in a state in which the gap d between the recording medium M and the recording head 25, in other words, the height position of the recording head 25 is not appropriate. For example, if the gap d between the recording head 25 and the recording medium M is too wide, in other words, if the height position of the recording head 25 is too high with respect to the recording medium M, ink droplets may be separated to generate satellites (satellite droplets) in a period from when ink is discharged to when the ink reaches the recording medium M. Such satellites land on the recording medium M, resulting in an abnormal image DP.

In addition to the above-described example, if the height position of the recording head 25 is inappropriate, the landing positions of ink droplets may shift and an image may be formed at an unintended position, or a dot may be formed rather than a circular dot like a normal dot, which causes an abnormal image DP. An abnormal image DP may occur due to a phenomenon called mist in which ink droplets become mist.

Such abnormal image DP is more likely to occur as the height position of the recording head 25 deviates from the proper position. For example, in the case of satellites, as the satellite length becomes longer, the appearance of the abnormal image DP is more remarkable. On the other hand, as the height position of the recording head 25 approaches the proper position, the occurrence of abnormal image DP can be restrained, and the shape of dots constituting the adjustment pattern AP also approaches a circle if there is no disturbance such as wind. Therefore, analyzing the above tendency based on the information on the abnormal image DP allows the recording head 25 to be adjusted to an appropriate height position.

In the example of imaging data (a) and imaging data (b) illustrated in FIG. 6, abnormal images DP are generated in formation regions ARf of adjustment patterns AP and a peripheral region ARp of an adjustment pattern AP formed at the upper height position of the recording head 25 farther from the recording medium M and the lower height position of the recording head 25 closer to the recording medium M.

On the other hand, no abnormal image DP is generated in a formation region and a peripheral region of an adjustment pattern group GPa formed at the height positions hf to hj between the acquisition positions of the above-mentioned imaging data (a) and imaging data (b).

The adjustment pattern group GPa includes all adjustment patterns APs formed at the respective height positions belonging to a predetermined continuous range, in other words, in the example of FIG. 6, at the respective height positions hf, hg, hh, hi, and hj belonging to a continuous range from the height position hf to the height position hj. In other words, the adjustment pattern group GPa includes the adjustment patterns APs that are continuously formed without the occurrence of abnormal image DP. In the adjustment patterns APs, for example, the dots are circular shapes close to the ideal shape, and no abnormal images DP such as satellites are generated in the formation regions and the peripheral regions.

The upper CPU 30 acquires information on the abnormal image DP from the analysis results of the above-mentioned imaging data (a) and (b) and the imaging data including the adjustment pattern group GPa. At this time, preferably, the information on the abnormal image DP is acquired not only from the formation region of the adjustment pattern AP but also from the peripheral region of the adjustment pattern AP. When satellites or mist of ink droplets adhere to a position on a recording medium M that is out of the formation region of the adjustment pattern AP, the satellites or mist of ink droplets may also adhere to the peripheral region of the adjustment pattern AP, as in the example of the imaging data (a).

Based on the acquired information on the abnormal image DP, for example, when the adjustment pattern group GPa continuously formed without the occurrence of the abnormal image DP exists as described above, the upper CPU 30 selects, for example, the adjustment pattern AP located in the center of the adjustment pattern group GPa collected as one group. The upper CPU 30 determines the height position hh corresponding to the selected adjustment pattern AP at an appropriate height position of the recording head 25 with respect to the recording medium M.

In other words, the upper CPU 30 searches for a group of adjustment pattern group GPa in which no abnormal image DP occurs, and selects the height position hh that is a median of the height positions hf, hg, hh, hi, and hj corresponding to the adjustment pattern group GPa as an appropriate height position of the recording head 25.

Adjusting the recording head 25 to the appropriate height position selected in this way allows the gap d between the recording medium M and the recording head 25 to be set to an appropriate value.

Note that there are various factors in the occurrence of the abnormal image DP, and high reproducibility may not be obtained depending on the presence or absence, type, location of occurrence, frequency of occurrence, etc. of the abnormal image DP. Therefore, the number of nozzles 25*a* used for forming the adjustment pattern AP is preferably as large as possible, and for example, two or more nozzles 25*a* are used as described above. Similarly, for the adjustment pattern AP, for example, adjustment patterns AP containing a predetermined number or more of dots are formed at the same height position and some similar patterns are prepared. Preferably, the height position of the recording head 25 in which the abnormal image DP does not occur is specified for all of the adjustment patterns AP.

Figure 7:
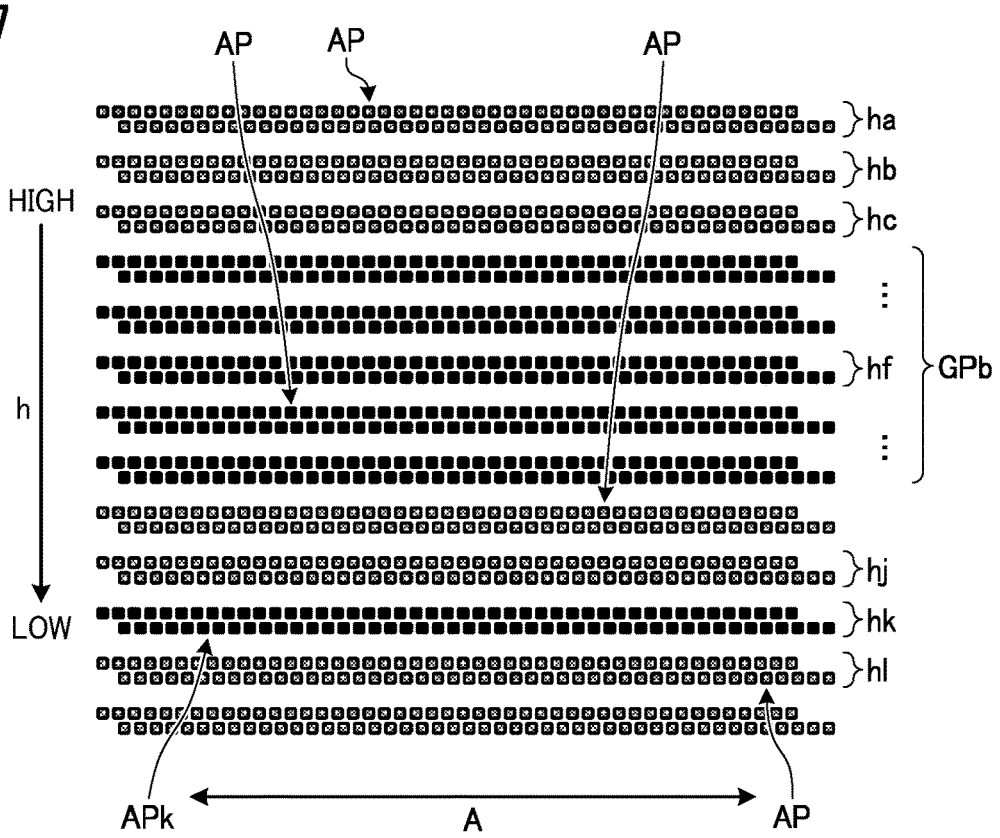
FIG. 7 is a diagram illustrating an example in which the height position of the recording head is selected based on a plurality of adjustment patterns formed on a recording medium by the liquid discharge apparatus according to an embodiment of the present disclosure.
Figure 8:
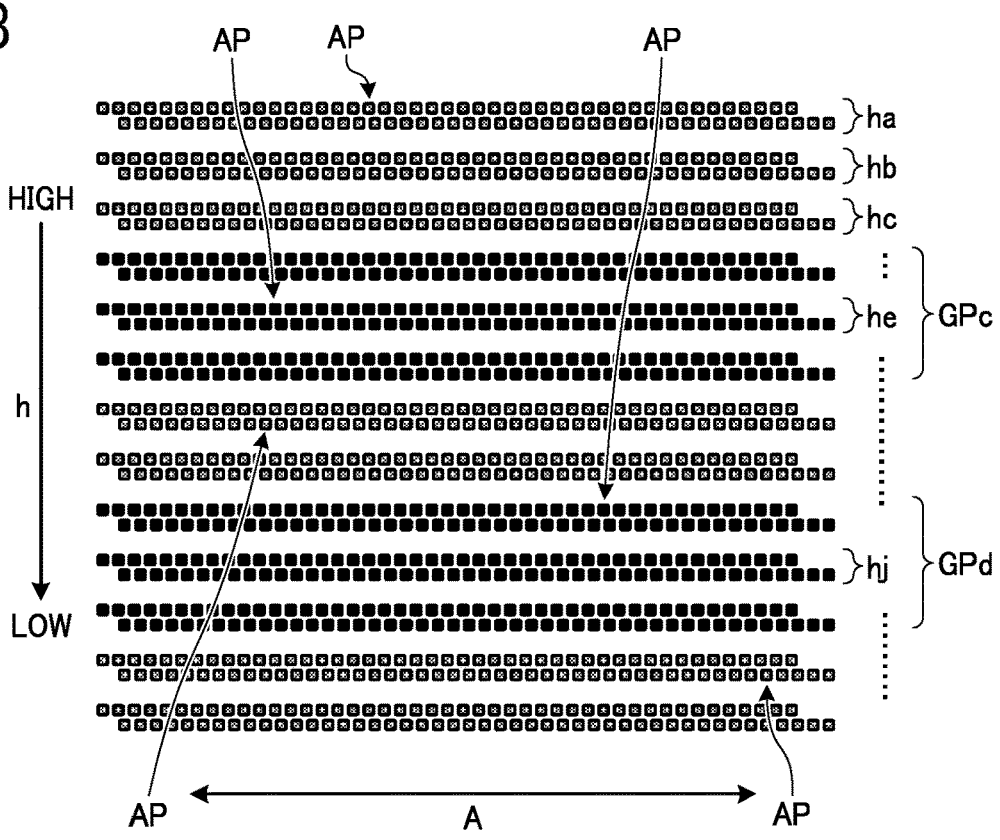
FIG. 8 is a diagram illustrating an example in which the height position of the recording head is selected based on a plurality of adjustment patterns formed on the recording medium by the liquid discharge apparatus according to an embodiment of the present disclosure.

FIGS. 7 and 8 illustrate other examples of selection of the height position of the recording head 25.

FIGS. 7 and 8 are diagrams illustrating an example in which the height position of the recording head 25 is selected based on the plurality of adjustment patterns AP formed on the recording medium M by the liquid discharge apparatus 1 according to an embodiment of the present disclosure. It is assumed that the plurality of adjustment patterns APs illustrated in FIGS. 7 and 8 are also formed by using two arbitrarily selected nozzles 25*a*, as in the case of FIG. 6 described above.

As illustrated in FIG. 7, it is assumed that, for example, an adjustment pattern group GPb and an isolated adjustment pattern APk are present from analysis results of the upper CPU 30.

The adjustment pattern group GPb includes all the adjustment patterns APs formed at the respective height positions belonging to a predetermined continuous range, and is continuously formed without the occurrence of the abnormal image DP. In other words, the adjustment pattern group GPb includes adjustment patterns APs corresponding to five height positions belonging to a predetermined continuous range.

The isolated adjustment pattern APk is an adjustment pattern AP formed at one height position hk without generating an abnormal image DP. Abnormal images DP occur in the adjustment patterns AP formed at the height positions hj and hl before and after the isolated adjustment pattern APk. In other words, the isolated adjustment pattern APk is an isolated adjustment pattern AP, in which no abnormal image DP is generated only by itself, interposed between the adjustment patterns AP in which the abnormal image DP is generated.

In such a case, the upper CPU 30 selects the adjustment pattern AP located in the center of the adjustment pattern group GPb instead of the isolated adjustment pattern APk. The upper CPU 30 determines the height position hf corresponding to the selected adjustment pattern AP at an appropriate height position of the recording head 25 with respect to the recording medium M.

As illustrated in FIG. 8, it is assumed that, for example, two adjustment pattern groups GPc and GPd are found to exist from the analysis result of the upper CPU 30.

Each of the adjustment pattern groups GPc and GPd includes all the adjustment patterns APs formed at the respective height positions belonging to a predetermined continuous range, and are continuously formed without the occurrence of abnormal image DP.

In other words, the adjustment pattern group GPc includes adjustment patterns APs corresponding to three height positions belonging to a predetermined continuous range. The height position he is the median value of the height positions corresponding to the adjustment pattern group GPc.

On the other hand, the adjustment pattern group GPd also includes adjustment patterns APs corresponding to three height positions belonging to a predetermined continuous range. The height position hj is the median value of the height positions corresponding to the adjustment pattern group GPd.

In this way, when the number of height positions belonging to the predetermined continuous range is equal between the adjustment pattern group GPc and the adjustment pattern group GPd, the upper CPU 30 selects the adjustment pattern AP from one adjustment pattern group including a height position closer to the recording medium M. In other words, in this case, the range including the height position hj as the median includes the height position closer to the recording medium M than the range including the height position he as the median.

Therefore, the upper CPU 30 selects the adjustment pattern AP located at the center of the adjustment pattern group GPd corresponding to the range including the height position hj as the median, not the adjustment pattern group GPc corresponding to the range including the height position he as the median. The upper CPU 30 determines the height position hj corresponding to the selected adjustment pattern AP at an appropriate height position of the recording head 25 with respect to the recording medium M.

The case where the number of height positions belonging to a predetermined continuous range is equal between adjustment pattern groups can be said to be the case where the width of change in height position in each range is equal. Further, the case where the number of height positions belonging to a predetermined continuous range is equal can be said to be the case where the number of adjustment patterns APs corresponding to each range is equal, in other words, the number of adjustment patterns is equal between the adjustment pattern group GPc and the adjustment pattern group GPd.

As described above, for example, the imaging data of the adjustment pattern AP is generated for each height position of the recording head 25 and analysis processing is proceeded in the order of generating the imaging data, thus restraining a plurality of ranges of adjustment pattern groups from being selected.

Height Adjustment Method

Figure 9:
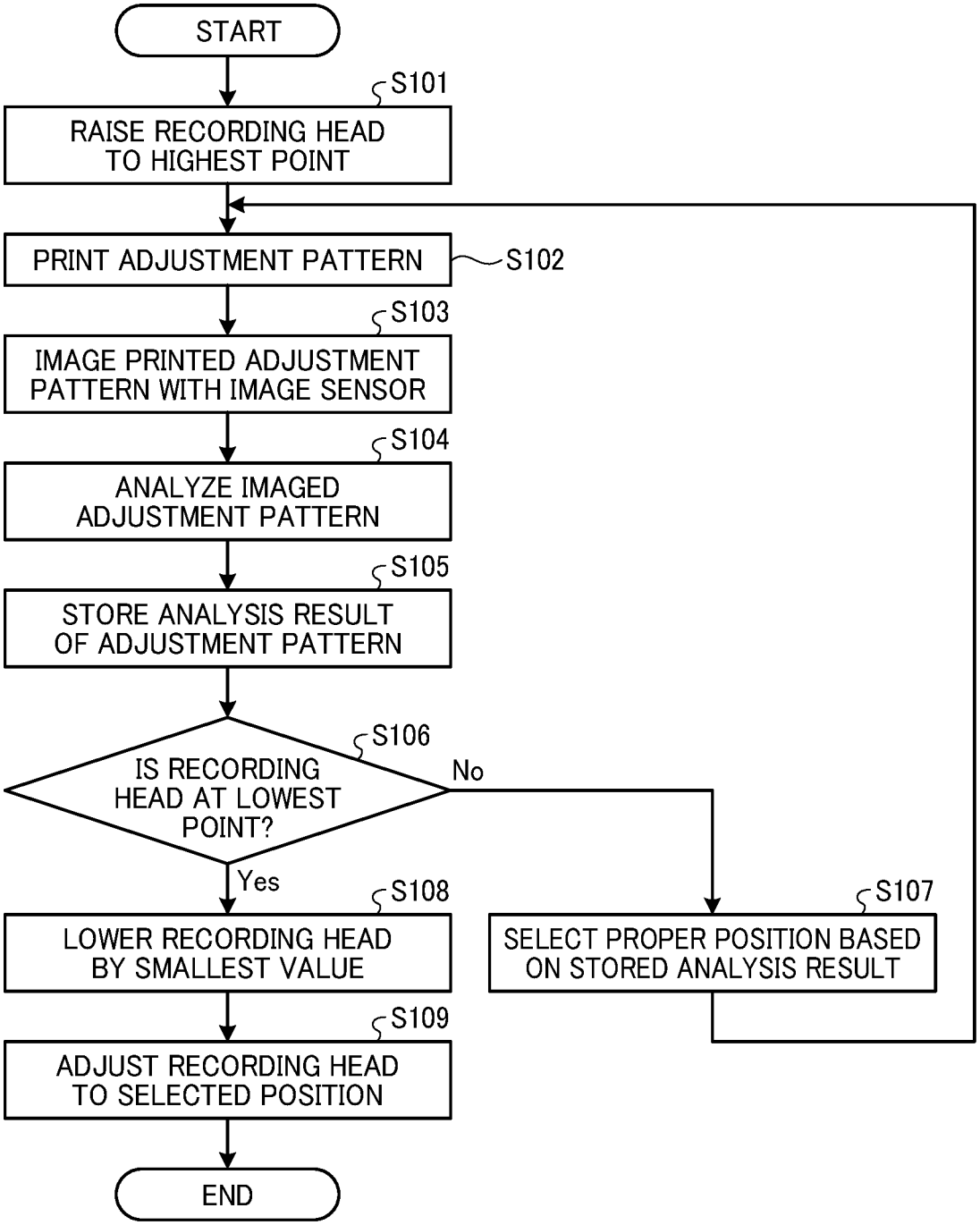
FIG. 9 is a flowchart illustrating an example of a procedure of a method for adjusting the height of a recording head in the liquid discharge apparatus according to an embodiment of the present disclosure.

Next, an example of a height adjustment method of the recording head 25 in the liquid discharge apparatus 1 according to an embodiment of the present disclosure is described with reference to FIG. 9. FIG. 9 is a flowchart illustrating an example of a procedure for adjusting the height of the recording head 25 in the liquid discharge apparatus 1 according to the present embodiment.

As illustrated in FIG. 9, when a recording medium M of unknown thickness and material is set in the liquid discharge apparatus 1, the height changing unit 36 of the upper CPU 30 controls the height changing mechanism 26 to raise the recording head 25 to the highest point of the height changing mechanism 26 (step S101).

The upper CPU 30 prints an adjustment pattern on the recording medium M at the highest point in the height position of the recording head 25 (step S102). In other words, the image data control unit 32 of the upper CPU 30 reads data related to the adjustment pattern from the data storage memory 34 and transmits the data to the image data output unit 35. The image data output unit 35 transmits the data related to the adjustment pattern to the recording head 25 and causes the recording head 25 to discharge ink at the highest point in the height position. Thus, an adjustment pattern is formed on the recording medium M.

The upper CPU 30 controls the image sensor 20 to image the adjustment pattern printed on the recording medium M (step S103). At this time, imaging is preferably performed to include not only the region where the adjustment pattern is formed but also the peripheral region of the adjustment pattern. The imaging data generated by the image sensor 20 is transmitted to the upper CPU 30.

The imaging data calculation unit 33 of the upper CPU 30 analyzes the imaging data including the adjustment pattern (step S104). In other words, the imaging data calculation unit 33 acquires information on the abnormal image from the formation region of the adjustment pattern and the peripheral region of the adjustment pattern that are included in the imaging data.

The imaging data calculation unit 33 saves the analysis result including the information related to the abnormal image in the data storage memory 34 of the upper CPU 30 (step S105).

The height changing unit 36 determines whether the height position of the recording head 25 has reached the lowest point (step S106).

If the height position of the recording head 25 has not reached the lowest point (NO in step S106), the height changing unit 36 controls the height changing mechanism 26 to lower the recording head 25 by the minimum value controllable by the height changing mechanism 26 (step S107). Thereafter, each part of the upper CPU 30 repeats the processing from step S102 at the changed height position of the recording head 25.

When the height position of the recording head 25 has reached the lowest point (YES in step S106), the imaging data calculation unit 33 selects an appropriate position as the height position of the recording head 25 with respect to the recording medium M set in the liquid discharge apparatus 1, based on the analysis result of the imaging data stored in the data storage memory 34 (step S108).

The height changing unit 36 controls the height changing mechanism 26 to adjust the height position of the recording head 25 so as to be the height position selected by the imaging data calculation unit 33 (step S109). Accordingly, the gap d, which is the distance between the discharge surface 25*s* of the recording head 25 and the upper surface of the recording medium M, is adjusted to an appropriate value.

As described above, the height adjustment process of the recording head 25 in the liquid discharge apparatus 1 according to the present embodiment is finished.

COMPARATIVE EXAMPLES

Hereinafter, the configurations of some comparative examples are described in comparison with the configuration of the liquid discharge apparatus 1 according to an embodiment of the present disclosure.

For example, in a first comparative example, in order to properly adjust the gap between a head and a sheet of paper, a table is created in which the shape of dots formed with ink discharged from the head is associated with the correction value for adjusting the gap between the head and the sheet of paper. A correction value is acquired from the table according to the shape of dots in an actually printed test pattern, and the gap between the head and the sheet of paper is adjusted using the acquired correction value.

Further, a second comparative example relates to a technology of measuring a gap value between a recording sheet and a head over the entire print range. Further, a third comparative example relates to a technology of performing color measurement based on imaging data obtained by imaging a print pattern.

By the way, in an inkjet printer, it is assumed that the user knows the material and thickness of a recording medium or that information such as the thickness of the recording medium is already registered in the inkjet printer. The gap between the recording medium and the recording head is adjusted according to the recording medium.

However, for example, when the user does not know the material and thickness of the recording medium, it may be difficult to properly adjust the gap between the recording medium and the recording head, which may cause an abnormal image such as the landing position shift of discharged ink.

For example, when the inkjet printer is a serial printer or the like that slides the recording head in the lateral direction to perform printing, recording media of various sizes, thicknesses, and materials are the printing targets. Therefore, the gap between the recording medium and the recording head is properly adjusted for each different recording medium in order to ensure the quality of an image formed on the recording medium.

When the above-mentioned technology of the first comparative example is applied to a recording medium whose thickness and material are unknown, a table in which correction values are comprehensively set for recording media having various thicknesses and materials. Implementation of such a technology is not realistic.

Further, as described above, the abnormal image that may occur in a printed image may be inferior in reproducibility. It may be difficult to select an effective correction value from a table created based on typological dot shapes to properly adjust the gap between the recording medium and the recording head.

In the liquid discharge apparatus 1 according to an embodiment of the present disclosure, the upper CPU 30 forms a plurality of adjustment patterns while changing the height position of the recording head 25, and determines the height position of the recording head based on the information on the abnormal image obtained from the imaging data. Thus, even if the thickness and material of the recording medium M are unknown, the gap d between the recording medium M and the recording head 25 is appropriately adjusted to form a high-quality image on the recording medium M.

In the liquid discharge apparatus 1 according to an embodiment of the present disclosure, the image sensor 20 is integrated with, for example, the recording head 25 and the height position of the image sensor 20 is changed in synchronization with the recording head 25 by the height changing mechanism 26. Accordingly, the imaging data captured at the positions following the recording head 25 can be generated, thus restraining variations in the analysis results of the upper CPU 30 between the imaging data, in other words, between a plurality of adjustment patterns.

In the liquid discharge apparatus 1 according to an embodiment of the present disclosure, the adjustment pattern includes dots formed with ink discharged from at least one nozzle 25*a* among the plurality of nozzles 25*a* included in the liquid discharge apparatus 1. As described above, since the adjustment pattern is formed of individually independent dots, the shapes and the like of the individual dots can be analyzed for each dot, thus allowing information on the abnormal image to be more accurately acquired.

In the liquid discharge apparatus 1 according to an embodiment of the present disclosure, the upper CPU 30 selects one or more adjustment patterns that correspond to height positions belonging to a predetermined continuous range, when no abnormal image is detected for all the adjustment patterns corresponding to the respective height positions belonging to the predetermined continuous range. As described above, a height position corresponding to a group of adjustment patterns continuously formed without occurrence of an abnormal image, for example, a height position that is the median of the adjustment patterns is selected. Thus, a wide margin that can restrain the occurrence of abnormal image can be taken, thus allowing a higher quality image to be formed on a recording medium M.

In the liquid discharge apparatus 1 according to an embodiment of the present disclosure, when there are a plurality of continuous ranges in which no abnormal image is detected and the plurality of continuous ranges have the same width of change in height position, the upper CPU 30 selects at least one adjustment pattern corresponding to the range to which a height position having a smaller gap D between the recording head 25 and the recording medium M belongs. Accordingly, the control performance of the landing position of discharged ink can be enhanced, and a high-resolution image can be easily obtained.

In the liquid discharge apparatus 1 according to an embodiment of the present disclosure, the upper CPU 30 acquires information on the abnormal image from, for example, a formation region of a plurality of adjustment patterns and a peripheral region of the plurality of adjustment patterns. Such a configuration can acquire information on the abnormal image more accurately and enhance the analysis accuracy of the imaging data.

The above-described embodiments are illustrative and do not limit the present disclosure. Thus, numerous additional modifications and variations are possible in light of the above teachings. For example, elements and/or features of different illustrative embodiments may be combined with each other and/or substituted for each other within the scope of the present disclosure. The elements of the above-described embodiments can be modified without departing from the gist of the present disclosure, and can be appropriately determined according to the application form.

Any one of the above-described operations may be performed in various other ways, for example, in an order different from the one described above.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

The invention claimed is:

1. A liquid discharge apparatus, comprising:

a recording head configured to discharge liquid onto a recording medium from above the recording medium to form an image on the recording medium;

a height changing mechanism configured to change a height position of the recording head;

an image sensor configured to capture the image on the recording medium; and control circuitry configured to:

cause the height changing mechanism to change the height position of the recording head at a predetermined timing to form a plurality of adjustment patterns on the recording medium at different height positions with the liquid discharged from the recording head;

cause the image sensor to capture image data for the plurality of adjustment patterns at each of the different height positions;

analyze the image data for each of the plurality of adjustment patterns at the different height positions for an abnormal image;

select at least one adjustment pattern from the plurality of adjustment patterns formed without an occurrence of an abnormal image;

determine, as the height position of the recording head, a height position corresponding to the at least one adjustment pattern.

2. The liquid discharge apparatus according to claim 1, wherein the image sensor is integrated with the recording head, and wherein the height changing mechanism is configured to change a height position of the image sensor in synchronization with the recording head.

3. The liquid discharge apparatus according to claim 1, wherein the recording head includes a plurality of nozzles configured to discharge the liquid, and wherein the plurality of adjustment patterns include dots formed with the liquid discharged from at least one of the plurality of nozzles.

4. The liquid discharge apparatus according to claim 1, wherein the at least one adjustment pattern comprises an adjustment pattern group;

wherein the control circuitry is configured to select the adjustment pattern group that includes adjustment patterns formed at height positions belonging to a continuous range, and continuously formed without an occurrence of an abnormal image.

5. The liquid discharge apparatus according to claim 4, wherein the control circuitry is configured to select an adjustment pattern located in a center of the adjustment pattern group; and determine the height position of the recording head corresponding to the selected adjustment pattern from the adjustment pattern group.

6. The liquid discharge apparatus according to claim 4, wherein the control circuitry is configured to determine the height position of the recording head corresponding to a median of the height positions corresponding to the adjustment pattern group.

7. The liquid discharge apparatus according to claim 1, wherein the at least one adjustment pattern comprises a plurality of adjustment pattern groups with each of the adjustment pattern groups including adjustment patterns formed at height positions belonging to a continuous range, and continuously formed without an occurrence of an abnormal image;

wherein the continuous range of the adjustment pattern groups is different;

wherein the control circuitry is configured to select one of the adjustment pattern groups including a height position closer to the recording medium.

8. The liquid discharge apparatus according to claim 1, wherein the control circuitry is configured to analyze the image data for each of the plurality of adjustment patterns from a formation region of the plurality of adjustment patterns and a peripheral region of the plurality of adjustment patterns.

9. The liquid discharge apparatus according to claim 1, wherein the control circuitry is configured to cause the height changing mechanism to change the height position of the recording head between a position as far as possible from the recording medium, and a position as close as possible to the recording medium.

10. The liquid discharge apparatus according to claim 1, wherein an amount of change in the height position of the recording head each time of the predetermined timing is set to a minimum value controllable by the height changing mechanism.

11. The liquid discharge apparatus according to claim 1, wherein an abnormal image depicts at least one feature selected from the group consisting of: a satellite droplet, a mist, and a non-circular dot.

12. The liquid discharge apparatus according to claim 1, wherein a thickness of the recording medium is unknown.

13. A method of adjusting a height of a recording head, the method comprising:

discharging liquid from the recording head at different height positions from above a recording medium to form a plurality of adjustment patterns on the recording medium while changing a height position of the recording head at a predetermined timing;

capturing image data for the plurality of adjustment patterns with an image sensor at each of the different height positions;

analyzing the image data for each of the plurality of adjustment patterns at the different height positions for an abnormal image;

selecting at least one adjustment pattern from the plurality of adjustment patterns formed without an occurrence of an abnormal image; and determining, as the height position of the recording head, a height position corresponding to the at least one adjustment pattern.

14. The method according to claim 13, wherein an abnormal image depicts at least one feature selected from the group consisting of: a satellite droplet, a mist, and a non-circular dot.

15. The method according to claim 13, wherein a thickness of the recording medium is unknown.

16. A liquid discharge apparatus, comprising:

a recording head configured to discharge liquid onto a recording medium from above the recording medium to form an image on the recording medium;

a height changing mechanism configured to change a height position of the recording head;

an image sensor configured to capture the image on the recording medium; and control circuitry configured to:

cause the height changing mechanism to change the height position of the recording head at a predetermined timing to form a plurality of adjustment patterns on the recording medium at different height positions with the liquid discharged from the recording head;

cause the image sensor to image the plurality of adjustment patterns;

identify, based on imaging data of the plurality of adjustment patterns, an adjustment pattern group that includes adjustment patterns formed at height positions belonging to a continuous range, and which no abnormal image occurs; and determine, as the height position of the recording head, a height position corresponding to the adjustment pattern group.

17. The liquid discharge apparatus according to claim 16, wherein the control circuitry is configured to select an adjustment pattern located in a center of the adjustment pattern group; and determine the height position of the recording head corresponding to the selected adjustment pattern from the adjustment pattern group.

18. The liquid discharge apparatus according to claim 16, wherein the control circuitry is configured to determine the height position of the recording head corresponding to a median of the height positions corresponding to the adjustment pattern group.

19. The liquid discharge apparatus according to claim 16, wherein an abnormal image depicts at least one feature selected from the group consisting of: a satellite droplet, a mist, and a non-circular dot.

20. The liquid discharge apparatus according to claim 16, wherein a thickness of the recording medium is unknown.

* * * * *